US012798049B2

(12) United States Patent
Alkhas et al.

(10) Patent No.: US 12,798,049 B2
(45) Date of Patent: Nov. 17, 2026

(54) ABRASIVE BODY AND METHOD OF MAKING THE SAME

(71) Applicant: 3M INNOVATIVE PROPERTIES COMPANY, St. Paul, MN (US)

(72) Inventors: Robinette S. Alkhas, St. Paul, MN (US); Paul N. Daveloose, Maplewood, MN (US); Jacob S. Beveridge, Stillwater, MN (US); Gregory G. Mehsikomer, Maplewood, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 17/997,678

(22) PCT Filed: May 7, 2021

(86) PCT No.: PCT/IB2021/053900
§ 371 (c)(1),
(2) Date: Nov. 1, 2022

(87) PCT Pub. No.: WO2021/229392
PCT Pub. Date: Nov. 18, 2021

(65) Prior Publication Data

US 2023/0166384 A1 Jun. 1, 2023

Related U.S. Application Data

(60) Provisional application No. 63/022,675, filed on May 11, 2020.

(51) Int. Cl.

| | |
|---|---|
| ***B24D 11/00*** | (2006.01) |
| ***B24D 3/28*** | (2006.01) |
| ***B24D 5/04*** | (2006.01) |

(52) U.S. Cl.
CPC ..... *B24D 11/001* (2013.01); *B24D 3/28* (2013.01); *B24D 5/04* (2013.01)

(58) Field of Classification Search
CPC ..... B24D 3/28; B24D 5/04; B24D 11/001
See application file for complete search history.

(56) References Cited

U.S. PATENT DOCUMENTS 2,958,593 A 11/1960 Hoover et al.
3,595,731 A 7/1971 Stanley
(Continued)

FOREIGN PATENT DOCUMENTS

CA 2527509 A1 12/2003
CN 86106743 A 4/1988
(Continued)

OTHER PUBLICATIONS

International Search Report for PCT Application No. PCT/IB2021/053900, mailed on Sep. 3, 2021, 4 pages.

*Primary Examiner* — Pegah Parvini

(57) ABSTRACT

An abrasive body comprises portions of a first abrasive element. The portions of the first abrasive element are bonded together by a first binder material. The first abrasive element comprises abrasive particles bonded to a substrate by at least a second binder material. The portions of the first abrasive element are not agglomerate abrasive particles. The abrasive body has a maximum dimension, and the portions of the first abrasive element have a maximum dimension that is less than 80 percent of the maximum dimension of the abrasive body. A method of making an abrasive body is also disclosed.

18 Claims, 3 Drawing Sheets

(56) References Cited

U.S. PATENT DOCUMENTS

| | | | | |
|---|---|---|---|---|
| 4,038,046 | A * | 7/1977 | Supkis | B24D 3/005 51/298 |
| 4,227,350 | A | 10/1980 | Fitzer | |
| 4,314,827 | A | 2/1982 | Leitheiser et al. | |
| 4,588,419 | A | 5/1986 | Caul et al. | |
| 4,609,380 | A | 9/1986 | Barnett et al. | |
| 4,623,364 | A | 11/1986 | Cottringer et al. | |
| 4,652,275 | A | 3/1987 | Bloecher et al. | |
| 4,734,104 | A | 3/1988 | Broberg | |
| 4,737,163 | A | 4/1988 | Larkey | |
| 4,744,802 | A | 5/1988 | Schwabel | |
| 4,751,138 | A | 6/1988 | Tumey et al. | |
| 4,770,671 | A | 9/1988 | Monroe et al. | |
| 4,799,939 | A | 1/1989 | Bloecher et al. | |
| 4,881,951 | A | 11/1989 | Wood et al. | |
| 4,991,362 | A | 2/1991 | Heyer et al. | |
| 5,152,917 | A | 10/1992 | Pieper et al. | |
| 5,201,916 | A | 4/1993 | Berg et al. | |
| 5,203,884 | A | 4/1993 | Buchanan et al. | |
| 5,213,591 | A | 5/1993 | Celikkaya et al. | |
| 5,366,523 | A | 11/1994 | Rowenshorst et al. | |
| 5,378,251 | A | 1/1995 | Culler et al. | |
| 5,417,726 | A | 5/1995 | Stout et al. | |
| 5,435,816 | A | 7/1995 | Spurgeon et al. | |
| 5,436,063 | A | 7/1995 | Follett et al. | |
| 5,496,386 | A | 3/1996 | Broberg et al. | |
| 5,520,711 | A | 5/1996 | Helmin | |
| 5,591,239 | A | 1/1997 | Larson et al. | |
| 5,609,706 | A | 3/1997 | Benedict et al. | |
| 5,639,541 | A | 6/1997 | Adam | |
| RE35,570 | E | 7/1997 | Rowenhorst et al. | |
| 5,643,068 | A | 7/1997 | Ward, Sr. | |
| 5,672,097 | A | 9/1997 | Hoopman et al. | |
| 5,681,361 | A | 10/1997 | Sanders, Jr. | |
| 5,687,916 | A | 11/1997 | Romano, III et al. | |
| 5,712,210 | A | 1/1998 | Windisch et al. | |
| 5,766,277 | A | 6/1998 | Devoe et al. | |
| 5,849,051 | A | 12/1998 | Beardsley et al. | |
| 5,858,140 | A | 1/1999 | Berger et al. | |
| 5,928,070 | A | 7/1999 | Lux | |
| 5,946,991 | A | 9/1999 | Hoopman et al. | |
| 5,954,844 | A | 9/1999 | Law et al. | |
| 5,961,674 | A | 10/1999 | Gagliardi et al. | |
| 5,975,987 | A | 11/1999 | Hoopman et al. | |
| 5,975,988 | A | 11/1999 | Christianson | |
| 5,984,988 | A | 11/1999 | Berg et al. | |
| 6,017,831 | A | 1/2000 | Beardsley et al. | |
| 6,066,189 | A | 5/2000 | Meyer et al. | |
| 6,077,601 | A | 6/2000 | Devoe et al. | |
| 6,129,540 | A | 10/2000 | Hoopman et al. | |
| 6,228,133 | B1 | 5/2001 | Thurber et al. | |
| 7,329,175 | B2 * | 2/2008 | Woo | B24D 11/02 451/538 |
| 7,985,269 | B2 | 7/2011 | Ludwig | |
| 8,034,137 | B2 | 10/2011 | Erickson et al. | |
| 8,142,531 | B2 | 3/2012 | Adefris et al. | |
| 8,142,532 | B2 | 3/2012 | Erickson et al. | |
| 8,142,891 | B2 | 3/2012 | Culler et al. | |
| 8,663,418 | B2 | 3/2014 | Kalkanoglu et al. | |
| 9,079,294 | B2 | 7/2015 | Holmes | |
| 10,022,841 | B2 | 7/2018 | Hsu et al. | |
| 10,131,036 | B2 | 11/2018 | Mase et al. | |
| 10,345,042 | B2 | 7/2019 | Mestanek et al. | |
| 2006/0041065 | A1 | 2/2006 | Barber, Jr. | |
| 2009/0165394 | A1 | 7/2009 | Culler et al. | |
| 2009/0169816 | A1 | 7/2009 | Erickson et al. | |
| 2010/0330288 | A1 | 12/2010 | Segars et al. | |
| 2012/0000135 | A1 * | 1/2012 | Eilers | B24D 11/001 51/298 |
| 2012/0227333 | A1 | 9/2012 | Adefris et al. | |
| 2012/0231707 | A1 * | 9/2012 | Pahl | B24D 11/02 51/298 |
| 2013/0040537 | A1 | 2/2013 | Schwabel et al. | |
| 2013/0125477 | A1 | 5/2013 | Adefris | |
| 2017/0252898 | A1 * | 9/2017 | Schillo-Armstrong | B24D 5/06 |
| 2018/0036866 | A1 | 2/2018 | Alkhas et al. | |
| 2018/0043507 | A1 | 2/2018 | Sato et al. | |
| 2018/0185983 | A1 | 7/2018 | Herbert et al. | |
| 2018/0339399 | A1 | 11/2018 | Inui et al. | |
| 2019/0202032 | A1 | 7/2019 | Alkhas et al. | |

FOREIGN PATENT DOCUMENTS

| | | | | |
|---|---|---|---|---|
| CN | 101579844 | A | 11/2009 | |
| CN | 102490128 | * | 11/2011 | B24D 18/00 |
| CN | 102490128 | A | 6/2012 | |
| CN | 202399162 | U | 8/2012 | |
| CN | 204868583 | U | 12/2015 | |
| CN | 107199521 | A | 9/2017 | |
| CN | 206982489 | U | 2/2018 | |
| FR | 2679167 | A3 | 1/1993 | |
| GB | 1146037 | * | 3/1969 | |
| JP | 2003211356 | A | 7/2003 | |
| KR | 100626252 | B1 | 9/2006 | |
| KR | 20180072142 | A | 6/2018 | |
| WO | 1995020469 | A1 | 8/1995 | |
| WO | 2015072337 | A1 | 5/2015 | |

* cited by examiner

ABRASIVE BODY AND METHOD OF MAKING THE SAME

CROSS-REFERENCE TO RELATED APPLICATIONS

This application is a national stage filing under 35 U.S.C. 371 of PCT/IB2021/053900, filed May 7, 2021, which claims the benefit of U.S. Provisional Application No. 63/022,675, filed May 11, 2020.

TECHNICAL FIELD

The present disclosure broadly relates to abrasive articles and methods of making them.

BACKGROUND

During the manufacture of abrasive finished goods, it is typical to generate waste material, for example, as trim or weed during conversion to the product final form (e.g., conversion of roll goods to discs). Such material is typically discarded and sent for disposal by incineration or landfill Both processes can have adverse environmental impact.

SUMMARY

The present disclosure provides a practical use for this waste by recycling it into abrasive bodies such as, for example, abrasive wheels and hand pads that are suitable for abrading a workpiece.

Accordingly, in one aspect, the present disclosure provides an abrasive body comprising portions of a first abrasive element, wherein the portions of the first abrasive element are bonded together by a first binder material, and wherein the first abrasive element comprises abrasive particles bonded to a substrate by at least a second binder material, wherein the portions of the first abrasive element are not agglomerate abrasive particles, wherein the abrasive body has a maximum dimension, and wherein the portions of the first abrasive element have a maximum dimension that is less than 80 percent of the maximum dimension of the abrasive body.

Abrasive bodies according to the present disclosure are suitable for abrading a workpiece. For example, the abrasive body may be frictionally contacted with a workpiece and moved relative to the workpiece to abrade the workpiece.

In another aspect, the present disclosure provides a method of making an abrasive body, the method comprising:

- combining portions of a first abrasive element and a curable binder precursor, wherein the first abrasive element comprises abrasive particles bonded to a substrate by at least a second binder material; and
- pressing and at least partially curing the curable binder precursor to provide the abrasive body, wherein the abrasive body has a maximum dimension, and wherein the portions of the first abrasive element have a maximum dimension that is less than 80 percent of the maximum dimension of the abrasive body.

Features and advantages of the present disclosure will be further understood upon consideration of the detailed description as well as the appended claims.

Figure 1:
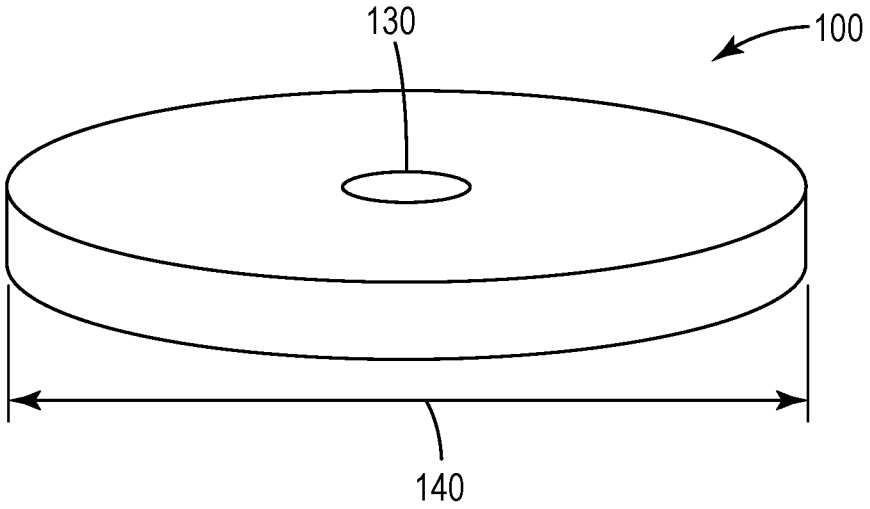
FIG. 1 is a schematic perspective view of an exemplary abrasive wheel 100 according to the present disclosure.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

Figure 1A:
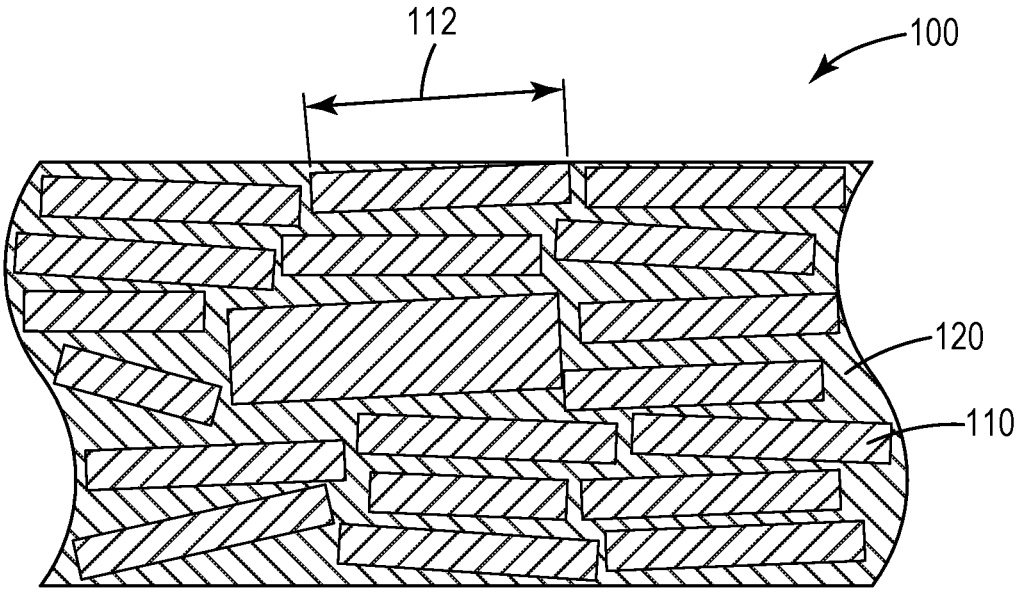
FIG. 1A is a schematic enlarged side view of abrasive wheel 100.

FIG. 1 shows an exemplary abrasive body (i.e., shown as abrasive wheel 100) having an optional central arbor hole 130) according to one embodiment of the present disclosure. Referring now to FIG. 1A, abrasive wheel 100 comprises portions of a first abrasive element 110. The portions of the first abrasive element are bonded together by a first binder material 120.

Abrasive wheel 100 has a maximum dimension 140. The portions of the first abrasive element 110 have a maximum dimension 112 that is less than 80 percent of the maximum dimension of the abrasive wheel. In many embodiments, the portions of the first abrasive element have a maximum dimension that is less than 70 percent, less than 60 percent, less than 50 percent, less than 40 percent, less than 30 percent, less than 20 percent, less than 10 percent, or even less than 5 percent of the maximum dimension of the abrasive body. In many embodiments, the portions of the first abrasive element have a maximum dimension that is at least 1 percent, at least 2 percent, at least 3 percent, at least 4 percent, at least 45 percent, or even at least 10 percent of the maximum dimension of the abrasive body. All possible combinations of the foregoing enumerated upper and lower maximum dimension limits may be used, although this is not a requirement.

In some preferred embodiments, the portions of the first abrasive element comprise recycled scrap material (e.g., edge trim, weed, or out of specification material) generated during the manufacture of finished abrasive articles such as, for example, nonwoven abrasive articles or coated abrasive articles. The portions of the first abrasive element may have any shape or size subject to the above limitation regarding maximum dimension that can fit (e.g., in at least one orientation after compression) within the desired volume of the abrasive body. In some embodiments, the recycled scrap material may include portions of used converted abrasive articles such as, e.g., nonwoven abrasive pads or discs, or coated abrasive discs, sheets, or belts. The portions of the first element may have a random shape, a predetermined shape, or a combination thereof.

In many embodiments, the size and shape of the portions of the first abrasive element will be heavily influenced by the recycling methods used. Examples include chopping, slicing, and/or shredding to provide smaller sizes of the first abrasive element that are suitable for recycling.

In addition to the portions of first abrasive elements, the abrasive body may further comprise portions of second, third, or fourth abrasive elements, for example. There is no particular upper limit to the number of types of abrasive elements that may be included in abrasive bodies according to the present disclosure. Generally, these optional portions of additional abrasive elements are independently also subject to the same dimensional limitations and embodiments as the portions of the first abrasive elements.

The portions of the first abrasive element do not consist of individual agglomerate abrasive particles, although they may contain them as part of a large abrasive element. As used herein, the term "abrasive agglomerate particles" refers to particles that are agglomerates of abrasive grains in an organic binder material or in an inorganic binder material (e.g., a glass or ceramic binder).

The first abrasive element comprises abrasive particles bonded to a substrate by at least a second binder material. Depending on the substrate, different types of abrasive articles are contemplated.

Figure 2:
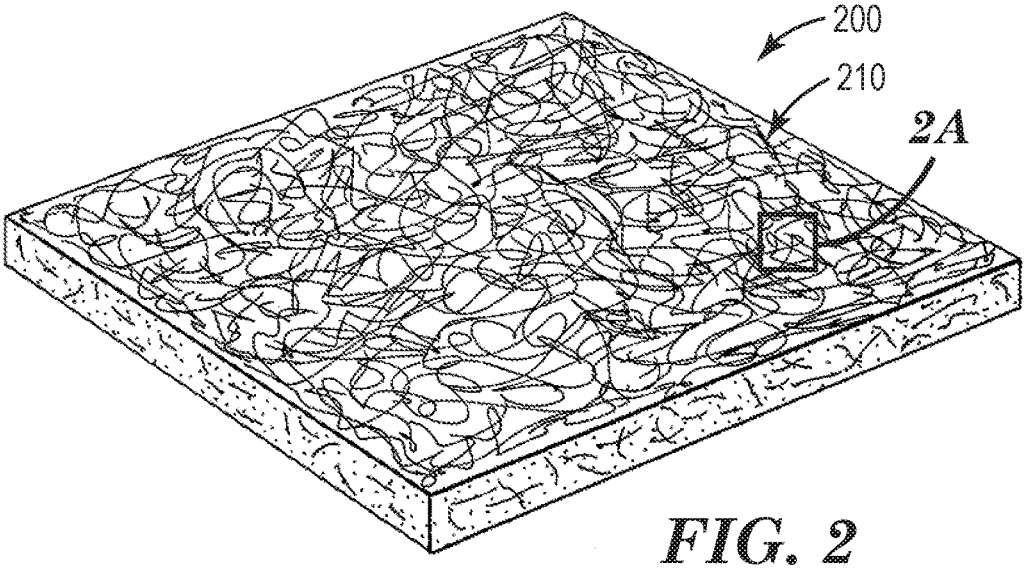
FIG. 2 is a perspective view of exemplary nonwoven abrasive element 200.
Figure 3:
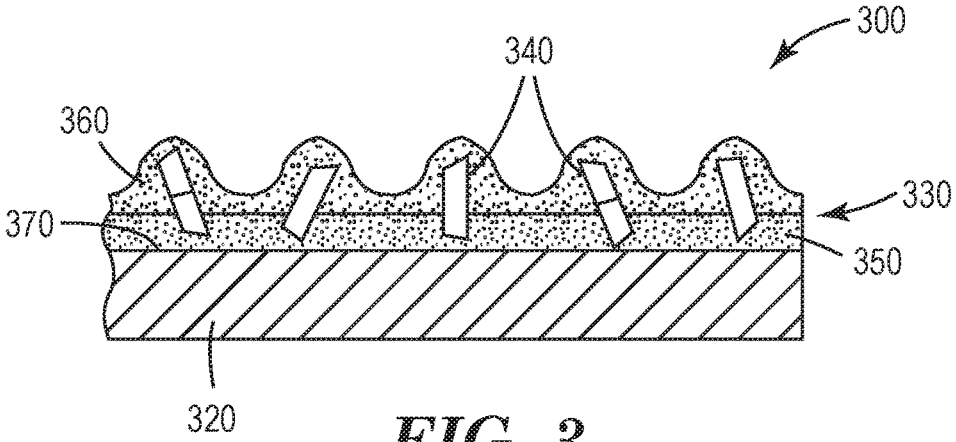
FIG. 3 is a side view of an exemplary coated abrasive element 300.
Figure 4:
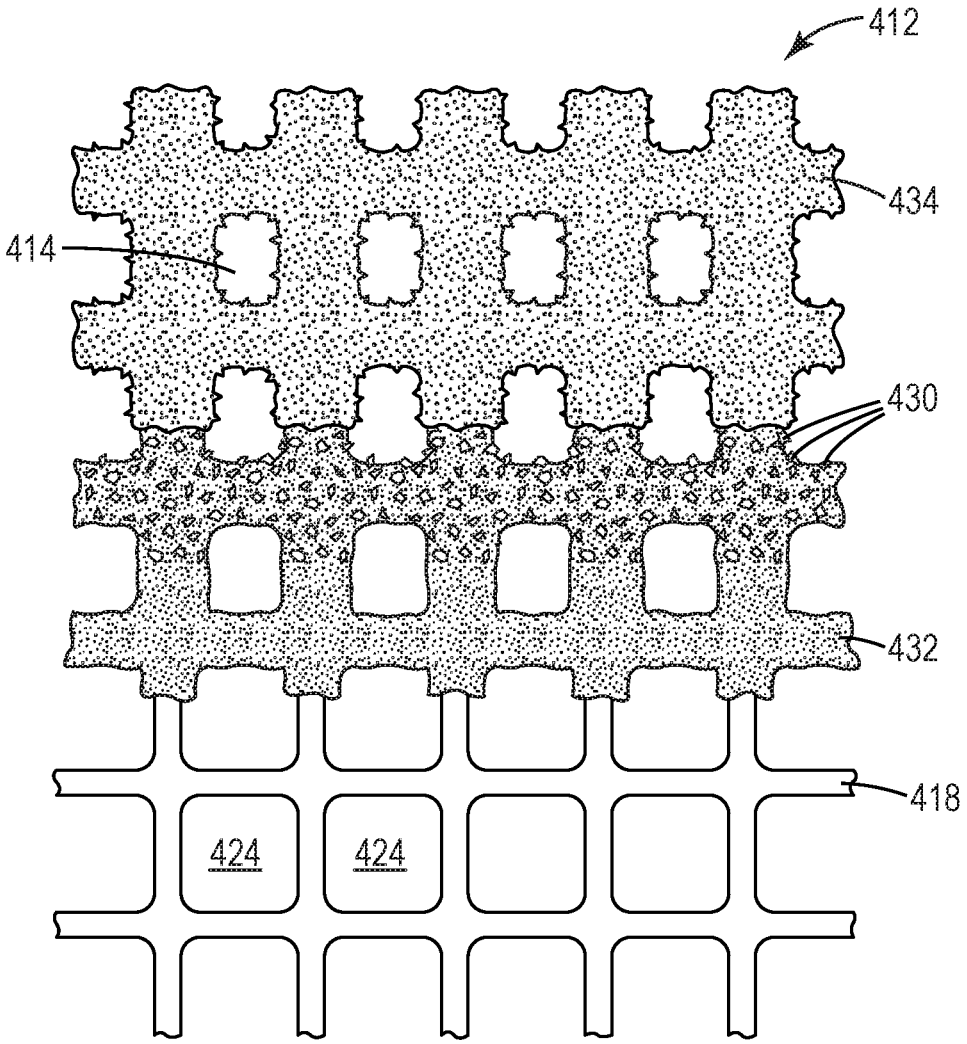
FIG. 4 is a schematic cutaway top view of an exemplary screen abrasive element 400.

Exemplary embodiments of suitable first abrasive elements are shown in FIGS. 2-4, described hereinbelow.

In some embodiments, the abrasive element may comprise a lofty open nonwoven fiber web with abrasive particles securely bonded thereto.

Figure 2A:
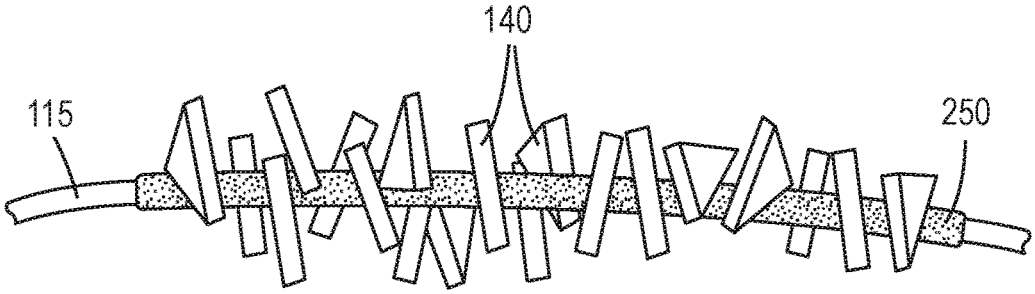
FIG. 2A is an enlarged view of region 2A of nonwoven abrasive element 200 shown in FIG. 2.

An exemplary embodiment of such an abrasive element is shown in FIGS. 2 and 2A. Referring now to FIGS. 2 and 2A, nonwoven abrasive article 200 comprises a lofty open low-density fibrous web (substrate) 210 formed of entangled fibers 215. Abrasive particles 240 are secured to fibrous web 210 on exposed surfaces of fibers 215 by binder material 250, which also binds fibers 215 together at points where they contact one another, resulting in cutting points being outwardly oriented relative to fibers 215.

Nonwoven fiber webs suitable for use are well known in the abrasives art. Typically, the nonwoven fiber web comprises an entangled web of fibers. The fibers may comprise continuous fiber, staple fiber, or a combination thereof.

The fiber web may be made, for example, by conventional air laid, carded, stitch bonded, spun bonded, wet laid, and/or melt blown procedures. Air laid fiber webs may be prepared using equipment such as, for example, that available under the trade designation RANDO WEBBER from Rando Machine Company of Macedon, New York.

Nonwoven fiber webs are typically selected to be compatible with adhering binder materials and abrasive particles while also being compatible with other components of the article, and typically can withstand processing conditions (e.g., temperatures) such as those employed during application and curing of the curable binder precursor. The fibers may be chosen to affect properties of the abrasive article such as, for example, flexibility, elasticity, durability or longevity, abrasiveness, and finishing properties. Examples of fibers that may be suitable include natural fibers, synthetic fibers, and mixtures of natural and/or synthetic fibers.

Prior to coating and/or impregnation with a curable binder material precursor, the nonwoven fiber web typically has a weight per unit area (i.e., basis weight) of at least about 50 grams per square meter (gsm), at least about 100 gsm, or at least about 150 gsm; and/or less than about 600 gsm, less than about 500 gsm, or less than about 400 gsm, as measured prior to any coating (e.g., with the curable binder precursor or optional pre-bond resin), although greater and lesser basis weights may also be used. In addition, prior to impregnation with the curable binder precursor, the fiber web typically has a thickness of at least about 3 mm, at least about 6 mm, or even at least about 10 mm; and/or is less than about 100 mm, less than about 50 mm, or less than about 25 mm, although greater and lesser thicknesses may also be useful.

Frequently, as known in the abrasives art, it is useful to apply a prebond resin to the nonwoven fiber web prior to coating with the curable binder material precursor. The prebond resin serves, for example, to help maintain the nonwoven fiber web integrity during handling Examples of prebond resins include phenolic resins, urethane resins, hide glue, acrylic resins, urea-formaldehyde resins, melamine-formaldehyde resins, epoxy resins, latexes, and combinations thereof.

In many embodiments, after coating the curable binder material precursor, for example, using any suitable method known in the art, abrasive particles are adhered to the curable binder material precursor, which is then cured to form the nonwoven abrasive element. Examples of curable binder material precursors include phenolic resins, urethane resins, hide glue, acrylic resins, urea-formaldehyde resins, melamine-formaldehyde resins, epoxy resins, latexes, and combinations thereof.

In other embodiments, the abrasive particles are pre-dispersed in the curable binder material precursor prior to coating and curing.

The abrasive particles may be the result of a crushing operation (e.g., crushed abrasive particles that have been sorted for shape and size) or the result of a shaping operation (i.e., shaped abrasive particles) in which an abrasive precursor material is shaped (e.g., molded), dried, and converted to ceramic material. Combinations of abrasive particles resulting from crushing with abrasive particles resulting from a shaping operation may also be used. The abrasive particles may be in the form of, for example, individual particles, agglomerates, composite particles, and mixtures thereof.

The abrasive particles should have sufficient hardness and surface roughness to function as crushed abrasive particles in abrading processes. Preferably, the abrasive particles have a Mohs hardness of at least 4, at least 5, at least 6, at least 7, or even at least 8.

Suitable abrasive particles include, for example, crushed abrasive particles comprising fused aluminum oxide, heat-treated aluminum oxide, white fused aluminum oxide, ceramic aluminum oxide materials such as those commercially available as 3M CERAMIC ABRASIVE GRAIN from 3M Company, St. Paul, Minnesota, brown aluminum oxide, blue aluminum oxide, silicon carbide (including green silicon carbide), titanium diboride, boron carbide, tungsten carbide, garnet, titanium carbide, diamond, cubic boron nitride, garnet, fused alumina zirconia, iron oxide, chromic, zirconia, titania, tin oxide, quartz, feldspar, flint, emery, sol-gel-derived ceramic (e.g., alpha alumina), and combinations thereof. Examples of sol-gel-derived abrasive particles from which the abrasive particles can be isolated, and methods for their preparation can be found, in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the abrasive particles could comprise abrasive agglomerates such, for example, as those described in U.S. Pat. No. 4,652,275 (Bloecher et al.) or U.S. Pat. No. 4,799,939 (Bloecher et al.). In some embodiments, the abrasive particles may be surface-treated with a coupling agent (e.g., an organosilane coupling agent) or other physical treatment (e.g., iron oxide or titanium oxide) to enhance adhesion of the crushed abrasive particles to the binder. The abrasive particles may be treated before combining them with the binder, or they may be surface treated in situ by including a coupling agent to the binder.

Preferably, the abrasive particles (and especially the abrasive particles) comprise ceramic abrasive particles such as, for example, sol-gel-derived polycrystalline alpha alumina particles. Ceramic abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Publ. Pat. Appln. Nos. 2009/0165394 A1 (Culler et al.) and 2009/0169816 A1 (Erickson et al.). Further details concerning methods of making sol-gel-derived abrasive particles can be found in, for example, U.S. Pat. No. 4,314,827 (Leitheiser); U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Publ. Pat. Appln. No. 2009/0165394 A1 (Culler et al.).

In some embodiments, useful abrasive particles (especially in the case of the abrasive particles) may be shaped abrasive particles can be found in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina abrasive particles that have been formed in a specific shape, then crushed to form shards that retain a portion of their original shape features. In some embodiments, the abrasive particles are precisely-shaped (i.e., the particles have shapes that are at least partially determined by the shapes of cavities in a production tool used to make them. Details concerning such abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. Nos. 2012/0227333 (Adefris et al.); 2013/0040537 (Schwabel et al.); and 2013/0125477 (Adefris).

Further details regarding nonwoven abrasive articles and methods for their manufacture can be found, for example, in U.S. Pat. No. 2,958,593 (Hoover et al.); U.S. Pat. No. 4,227,350 (Fitzer); U.S. Pat. No. 4,991,362 (Heyer et al.); U.S. Pat. No. 5,712,210 (Windisch et al.); U.S. Pat. No. 5,591,239 (Edblom et al.); U.S. Pat. No. 5,681,361 (Sanders); U.S. Pat. No. 5,858,140 (Berger et al.); U.S. Pat. No. 5,928,070 (Lux); U.S. Pat. No. 6,017,831 (Beardsley et al.), and in U.S. Pat. Appl. Publ. Nos. 2006/0041065 A 1 (Barber, Jr.) and 2018/0036866 (Alkas et al.). Many such nonwoven abrasive articles are known and marketed commercially.

An exemplary embodiment of a coated abrasive article according to the present disclosure is depicted in FIG. 3. Referring now to FIG. 3, coated abrasive article 300 has backing 320 and abrasive layer 330. Abrasive layer 330 includes abrasive particles 340 secured to major surface 370 of backing 320 (substrate) by make layer 350 and size layer 360.

Coated abrasive elements may include a make layer disposed on a backing (substrate), a size layers, and abrasive particles disposed between the make and size layers, and may also include an optional supersize layer that is superimposed on the abrasive layer, or a backing antistatic treatment layer may also be included, if desired. In some embodiments, the abrasive particles are dispersed in a binder material, generally coated as a slurry onto a backing.

Useful backings include, for example, those known in the art for making coated abrasive articles. Typically, the backing has two opposed major surfaces, although this is not a requirement.

The make layer and/or size layer is/are formed by at least partially curing a corresponding curable precursor material. Examples of curable precursor materials that may be useful for make layer and/or size layer precursor compositions include, free-radically polymerizable monomers and/or oligomers, epoxy resins, acrylic resins, urethane resins, phenolic resins, urea-formaldehyde resins, melamine-formaldehyde resins, aminoplast resins, cyanate resins, or combinations thereof. Useful binder precursors include thermally curable resins and radiation curable resins, which may be cured, for example, thermally and/or by exposure to radiation. Additional details concerning size layer precursors may be found in U.S. Pat. No. 4,588,419 (Caul et al.), U.S. Pat. No. 4,751,138 (Tumey et al.), and U.S. Pat. No. 5,436,063 (Follett et al.).

The make layer and/or size layer precursor compositions may also contain additives such as, for example, fibers, lubricants, wetting agents, surfactants, pigments, dyes, antistatic agents (e.g., carbon black, vanadium oxide, and/or graphite), coupling agents (e.g., silanes, titanates, and/or zircoaluminates), plasticizers, and/or suspending agents. The amounts of these optional additives are selected to provide the preferred properties. The coupling agents can improve adhesion to the abrasive particles and/or filler. The curable composition may be thermally-cured, radiation-cured, or a combination thereof.

The make layer and/or size layer precursor compositions may also contain filler materials, diluent abrasive particles (e.g., as described hereinbelow), or grinding aids, typically in the form of a particulate material. Typically, the particulate materials are inorganic materials. Examples of useful fillers for this disclosure include: metal carbonates (e.g., calcium carbonate (e.g., chalk, calcite, marl, travertine, marble and limestone), calcium magnesium carbonate, sodium carbonate, magnesium carbonate), silica (e.g., quartz, glass beads, glass bubbles and glass fibers) silicates (e.g., talc, clays, (montmorillonite) feldspar, mica, calcium silicate, calcium metasilicate, sodium aluminosilicate, sodium silicate) metal sulfates (e.g., calcium sulfate, barium sulfate, sodium sulfate, aluminum sodium sulfate, aluminum sulfate), gypsum, vermiculite, wood flour, aluminum trihydrate, carbon black, metal oxides (e.g., calcium oxide (lime), aluminum oxide, titanium dioxide), and metal sulfites (e.g., calcium sulfite).

The make layer and/or size layer precursor compositions may also be modified by various additives (e.g., fibers, lubricants, wetting agents, surfactants, pigments, dyes, antistatic agents (e.g., carbon black, vanadium oxide, and/or graphite), coupling agents (e.g., silanes, titanates, zircoaluminates, etc.), plasticizers, suspending agents). Catalysts and/or initiators may be added to thermosetting resins; for example, according to conventional practice and depending on the resin used.

Abrasive particles described herein, are generally suitable for inclusion in the coated abrasive elements.

Optionally, a supersize layer may overlay the size layer. The supersize layer may contain antiloading additive and/or grinding aid, for example.

Further details concerning coated abrasive articles, and how to make them, are well known and are described, for example, in U.S. Pat. No. 4,734,104 (Broberg); U.S. Pat. No. 4,737,163 (Larkey); U.S. Pat. No. 5,203,884 (Buchanan et al.); U.S. Pat. No. 5,152,917 (Pieper et al.); U.S. Pat. No. 5,378,251 (Culler et al.); U.S. Pat. No. 5,417,726 (Stout et al.); U.S. Pat. No. 5,436,063 (Follett et al.); U.S. Pat. No. 5,496,386 (Broberg et al.); U.S. Pat. No. 5,609,706 (Benedict et al.); U.S. Pat. No. 5,520,711 (Helmin); U.S. Pat. No.

5,954,844 (Law et al.); U.S. Pat. No. 5,961,674 (Gagliardi et al.); U.S. Pat. No. 4,751,138 (Bange et al.); U.S. Pat. No. 5,766,277 (DeVoe et al.); U.S. Pat. No. 6,077,601 (DeVoe et al.); U.S. Pat. No. 6,228,133 (Thurber et al.); and U.S. Pat. No. 5,975,988 (Christianson).

In some embodiments, the first abrasive element comprises a porous substrate having abrasive particles secured thereto by at least one binder material.

In some embodiments, the porous substrate comprises an open mesh backing (substrate), which may be woven or nonwoven, having first and second opposed major surfaces and a plurality of openings extending from the first major surface to the second major surface. An abrasive layer comprising a plurality of abrasive particles dispersed in, or bonded to, a binder material (either including make and size layers or a slurry layer, for example) is secured to at least a portion of the first major surface of the backing, in some embodiments, the entire backing may be coated with the abrasive layer. Binders and abrasive particles may be selected, for example, from those described elsewhere herein.

Referring now to FIG. 4, screen abrasive element 412 comprises an open mesh backing 418 covered with an abrasive layer. The open mesh backing 418 has a plurality of openings 424. The abrasive layer comprises a make layer 432, abrasive particles 430, and a size layer 434. A plurality of openings 414 extend through the screen abrasive 412. Further details concerning mesh or screen abrasive articles and how to make them can be found in, for example, U.S. Pat. No. 7,329,175 (Rambosek et al.).

Similar constructions involving a porous substrate such as, for example, a porous foam or a perforated polymer film, are also known, and are described, for example in U.S. Pat. No. 5,849,051 (Beardsley et al.).

The substrate can be a polymer film, a woven or knitted fabric, or porous resilient foam.

Many other type or abrasive elements not described here may also be suitable for use in the present disclosure. Abrasive bodies according to the present disclosure can be prepared by a process in which portions of the first abrasive element and a curable first binder material precursor are placed in a circular mold, typically under pressure, and cured, for example, curing by heating and/or spontaneous chemical reaction. Depending on the applied pressure and porosity of the components in the mold, the density of the resulting abrasive body may vary widely, for example, depending on its intended use. Abrasive bodies that may be produced in this way may include deburring wheels, polishing wheels, blending wheels, grinding wheels, sanding blocks, and abrasive hand pads, for example.

Details are within the capabilities of those of ordinary skill in the art, and will generally depend on the curable binder material precursor selected. The curable first binder material precursor may be any curable binder precursor material described herein, including, for example, phenolic resins, urethane resins, hide glue, acrylic resins, urea-formaldehyde resins, melamine-formaldehyde resins, epoxy resins, and combinations thereof.

Optionally, abrasive bodies according to the present disclosure may contain additives such as grinding aids, fillers, secondary abrasive particles (e.g., abrasive particles as described hereinabove), pore formers, and reinforcing fibers and scrims other than as may be present in portions of abrasive element(s).

Objects and advantages of this disclosure are further illustrated by the following non-limiting examples, but the particular materials and amounts thereof recited in these examples, as well as other conditions and details, should not be construed to unduly limit this disclosure.

EXAMPLE 1

Nonwoven abrasive weed material from the conversion of Scotch-Brite A Medium nonwoven abrasive from a roll into discs was fed into a Cumberland/John Brown rotor cutting tool with a 0.5 inch (1.27 cm) screen to obtain chopped weed. The chopped weed was saturated with a urethane solution containing 32 parts by weight of ketoxime-blocked poly-1,4-butylene glycol (obtained as Adiprene BL-31 from Lanxess, Pittsburgh, Pennsylvania), and 6 parts by weight (pbw) of an amine curing agent (obtained as Kayahard AA from Nippon Kayaku Co. Inc., Tokyo, Japan), and 9 pbw of propylene glycol monomethyl ether acetate (obtained as Arcosolv PM Acetate from Arco Chemical Co., Houston, Texas), and 6 pbw of synthetic hydrocarbon wax (obtained as MP-22VF from Micro Powders, Inc., Tarrytown, New York), and 47 pbw of the nonwoven abrasive weed. The saturated weed was placed into a rectangular tray and manipulated into a visually uniform 1-inch (2.5-cm) high shape. The 1-inch (2.5-cm) high stack was folded in half to provide a 2-inch (5.1-cm) high formed shape and placed into another flexible tray with release liners made of polytetrafluoroethylene. The entire assembly was placed into a heated hydraulic press at 275° F. (135° C., 10000 psi (69 MPa)), compressed to 0.5 inches (1.3 cm) and then held for 15 minutes to produce an abrasive slab. The slab was removed from the press and cured further in a convection air oven for 3 hours at 275° F. (135° C.). The slabs were removed and abrasive wheels having a 3-inch (7.6-cm) diameter and a 0.375-inch diameter (0.953-cm) center hole were die cut from the slab.

An abrasive wheel was mounted on the arbor of an air powered tool which rotated at 25,000 revolutions per minute. The rotating wheel was urged against a carbon steel, stainless steel, and aluminum metal plates, and was found to be useful for deburring edges, removing mill marks, and polishing the surfaces of the metal plates.

All cited references, patents, and patent applications in this application are incorporated by reference in a consistent manner. In the event of inconsistencies or contradictions between portions of the incorporated references and this application, the information in this application shall control. The preceding description, given in order to enable one of ordinary skill in the art to practice the claimed disclosure, is not to be construed as limiting the scope of the disclosure, which is defined by the claims and all equivalents thereto.

What is claimed is:

1. An abrasive body comprising portions of a first abrasive element, wherein the portions of the first abrasive element include a porous resilient foam, wherein the portions of the first abrasive element are bonded together by a first binder material, and wherein each of the portions of the first abrasive element comprises abrasive particles bonded to a substrate by at least a second binder material, wherein the portions of the first abrasive element are not agglomerate abrasive particles, wherein the abrasive body has a maximum dimension, wherein each of the portions of the first abrasive element has a maximum dimension that is less than 80 percent of the maximum dimension of the abrasive body, and wherein the abrasive particles, the substrate, and the second binder material are, collectively, recycled scrap.

2. The abrasive body of claim 1, wherein the substrate comprises a lofty open nonwoven fiber web.

3. The abrasive body of claim 1, wherein the substrate comprises a nonwoven fiber web including synthetic fibers.

4. The abrasive body of claim 1, wherein the substrate comprises a polymer film, a woven or knitted fabric, or porous resilient foam.

5. The abrasive body of claim 1, wherein the portions of the first abrasive element are randomly shaped.

6. The abrasive body of claim 1, wherein the substrate comprises a polymer film.

7. A method of making the abrasive body of claim 1, the method comprising:

combining the portions of the first abrasive element and a curable binder material precursor, wherein each portion of the first abrasive element comprises the abrasive particles bonded to the substrate by at least the second binder material; and pressing and at least partially curing the curable binder material precursor to provide the abrasive body.

8. The method of claim 7, wherein the substrate comprises a lofty open nonwoven fiber web.

9. The method of claim 7, wherein the substrate comprises a nonwoven fiber web including synthetic fibers.

10. The method of claim 7, wherein the substrate comprises a polymer film, woven or knitted fabric, or porous resilient foam.

11. The method of claim 7, further comprising disposing a reinforcing scrim in contact with the portions of the first abrasive element and the curable binder precursor.

12. The method of claim 7, wherein the portions of the first abrasive element are randomly shaped.

13. An abrasive body comprising portions of a first abrasive element, wherein the portions of the first abrasive element include a porous resilient foam, wherein the portions of the first abrasive element are bonded together by a first binder material, and wherein each of the portions of the first abrasive element comprises abrasive particles bonded to a substrate by at least a second binder material, wherein the second binder material is a cured resin, wherein the portions of the first abrasive element are not agglomerate abrasive particles, wherein the abrasive body has a maximum dimension, wherein each of the portions of the first abrasive element has a maximum dimension that is less than 80 percent of the maximum dimension of the abrasive body, and wherein the portions of the first abrasive element are recycled scrap generated during the manufacture of finished abrasive articles or that include portions of used converted abrasive articles.

14. The abrasive body of claim 13, wherein the substrate comprises a lofty open nonwoven fiber web.

15. The abrasive body of claim 13, wherein the substrate comprises a nonwoven fiber web including synthetic fibers.

16. The abrasive body of claim 13, wherein the substrate comprises a polymer film.

17. The abrasive body of claim 13, wherein the portions of the first abrasive element are randomly shaped.

18. The abrasive body of claim 14, wherein the lofty open nonwoven fiber web includes synthetic fibers.

* * * * *